US011542648B2

(12) United States Patent
Noh et al.

(10) Patent No.: US 11,542,648 B2
(45) Date of Patent: Jan. 3, 2023

(54) LAUNDRY TREATING APPARATUS HAVING INDUCTION HEATER AND CONTROL METHOD THEREOF

(71) Applicant: LG Electronics Inc., Seoul (KR)

(72) Inventors: Hyunwoo Noh, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 297 days.

(21) Appl. No.: 16/713,771

(22) Filed: Dec. 13, 2019

(65) Prior Publication Data

US 2020/0190720 A1 Jun. 18, 2020

(30) Foreign Application Priority Data

Dec. 13, 2018 (KR) ..... 10-2018-0161337

(51) Int. Cl.
*D06F 25/00* (2006.01)
*D06F 58/30* (2020.01)
(Continued)

(52) U.S. Cl.
CPC ..... *D06F 25/00* (2013.01); *D06F 33/00* (2013.01); *D06F 58/30* (2020.02);
(Continued)

(58) Field of Classification Search
None
See application file for complete search history.

(56) References Cited

U.S. PATENT DOCUMENTS

2006/0254082 A1* 11/2006 Kim ..... D06F 58/02 34/595
2014/0033562 A1* 2/2014 Altinier ..... D06F 58/38 34/499
2018/0057995 A1* 3/2018 Kim ..... D06F 37/04

FOREIGN PATENT DOCUMENTS

DE 102009026646 12/2010
DE 102016110871 11/2017
(Continued)

OTHER PUBLICATIONS

Espacenet translation JP 2013-150659 A, Toshiba Clothes Dryer, Kawabata (Year: 2013).*
(Continued)

*Primary Examiner* — Cristi J Tate-Sims
(74) *Attorney, Agent, or Firm* — Fish & Richardson P.C.

(57) ABSTRACT

Disclosed are an object treating apparatus, and more particularly, an object treating apparatus for heating a drum using an induction heater and a control method thereof. The object treating apparatus includes a tub; a drum rotatably disposed within the tub and accommodating an object therein; an induction heater disposed on the tub and configured to heat an outer circumferential face of the drum contacting the heater; a motor to rotate the drum; and a processor configured to control an operation of the induction heater to dry the object, wherein the processor is configured to control revolution per minute (RPM) of the drum to perform, during drying: a conductive accelerating motion having a target RPM in which the object rotates integrally with the drum while the object is in close contact with an inner circumferential face of the drum; and a rearrangement motion having a target RPM lower than the target RPM of the conductive accelerating motion.

20 Claims, 8 Drawing Sheets

(51) Int. Cl.

| | |
|---|---|
| ***D06F 33/00*** | (2020.01) |
| *D06F 105/46* | (2020.01) |
| *D06F 103/00* | (2020.01) |
| *D06F 103/34* | (2020.01) |
| *D06F 103/44* | (2020.01) |
| *D06F 105/28* | (2020.01) |

(52) U.S. Cl.
CPC ..... *D06F 2103/00* (2020.02); *D06F 2103/34* (2020.02); *D06F 2103/44* (2020.02); *D06F 2105/28* (2020.02); *D06F 2105/46* (2020.02)

(56) References Cited

FOREIGN PATENT DOCUMENTS

| | | |
|---|---|---|
| JP | 2009082258 | 4/2009 |
| JP | 2013150659 | 8/2013 |
| KR | 1020130091101 | 8/2013 |
| KR | 101683122 | 12/2016 |

OTHER PUBLICATIONS

Extended European Search Report in European Application No. 19215921.8, dated Mar. 11, 2020, 9 pages.
PCT International Search Report in International Application No. PCT/KR2019/017634, dated Apr. 16, 2020, 10 pages.

* cited by examiner

LAUNDRY TREATING APPARATUS HAVING INDUCTION HEATER AND CONTROL METHOD THEREOF

CROSS-REFERENCE TO RELATED APPLICATION(S)

This application claims the benefit of Korean Patent Application No. 10-2018-0161337, filed on Dec. 13, 2018, which is hereby incorporated by reference as when fully set forth herein.

TECHNICAL FIELD

The present disclosure relates to a laundry treating apparatus, and more particularly, to a laundry treating apparatus for heating a drum using an induction heater and a control method thereof.

BACKGROUND

A laundry washing apparatus includes a tub (outer tub) for storing washing-water and a drum (inner tub) disposed rotatably in the tub. Laundry is contained inside the drum. As the drum rotates, the laundry is washed using detergent and washing-water.

In order to enhance the washing effect by promoting activation of detergents and decomposition of contaminants, hot washing-water is fed into the tub or heated inside the tub. To this end, generally, an inner bottom of the tub is recessed downward to form a heater mount, and a heater is mounted into the heater mount. Such a heater is generally a sheath heater.

In order to add a drying function to the washing apparatus, a duct for air circulation, a duct for generating an air flow, and a heater for heating the air may be additionally provided. The air heating heater is generally a sheath heater. In this case, the heater suctions the air from a lower space in rear of the tub and then supplies heated air from an upper space in front of the drum. In addition, cooling water may be supplied to an inside of the duct to cool hot and humid air to generate condensed moisture.

Therefore, in addition to essential components for washing, ducts, a fan and a sheath heater, etc. must be additionally provided to perform only drying, thus increasing a manufacturing cost and complicating a structure and control of the apparatus.

In a conventional laundry treating apparatus also known as a combo type laundry treating apparatus to which a drying function is added, drying is performed by supplying hot air into the drum while performing a tumbling operation. The tumbling operation refers to an operation of lifting and dropping laundry by rotating the drum at approximately 40 to 60 RPM. This tumbling operation is performed by repeating forward and reverse rotations of the drum. When a controller changes a rotation direction, the drum stops temporarily. That is, after accelerating the rotation of the drum in one direction, the drum is rotated for a predetermined time duration at a target RPM. Then, the controller decelerates the rotation of the drum such that the drum is stopped. Thereafter, after accelerating the rotation of the drum in an opposite direction, the drum is rotated for a predetermined time duration at a target RPM. Then, the controller decelerates the rotation of the drum such that the drum is stopped.

Hot air is supplied inside the drum in synchronization with the operation of the drum. The hot air heats the laundry and evaporates the moisture from the laundry. The hot humid air from which the moisture has evaporated away is discharged out of the tub and then cooled and converted into cold dry air. The low temperature dry air is heated and fed back into the drum.

However, in the conventional hot-air drying type laundry treating apparatus, in the tumbling operation, a laundry mixing or laundry spreading value is small, so that a heat transfer efficiency is small. That is, a rotation force of the drum is transmitted not only to an inner circumferential face of the drum but also to the laundry disposed at a center of the drum. However, the hot air is not effectively transmitted to the laundry disposed at the center of the drum because the laundry mixing or laundry spreading value is small. Therefore, the heat transfer efficiency to the entire laundry is low, such that the drying efficiency is low. There is a possibility that a drying imbalance and a partially excessive drying may occur. In particular, this problem may be more outstanding when an amount of the laundry to be dried is large. Therefore, there is a need to find a way to eliminate the drying imbalance and evenly dry the entire laundry.

Further, in the conventional laundry treatment apparatus of the hot air drying type, a position of the laundry may continue to change during the tumbling operation. In this connection, the laundry items may be rubbed continuously against each other or the laundry items may be entangled with each other, thereby causing shrinkage or deformation of the laundry. That is, a large mechanical force is generated between the laundry items, such that there is a possibility that a damage to the laundry occurs during the drying process. Approximately 80% of a main cause of the shrinkage or deformation of the laundry during drying may be the mechanical force generated between the laundry rather than the heat. Therefore, it is necessary to find a way to minimize the shrinkage or deformation of the laundry due to the mechanical force while increasing the drying efficiency.

When large sized laundry such as a blanket or padding, that is, a bulky load is treated in the conventional laundry treatment apparatus of the hot air drying type, positions of the loads in the drum does not change significantly. That is, a position or posture of the large sized laundry is hardly changed from a start of drying to an end thereof while the laundry remains at a specific position of the drum. When the blanket is a load in one example, a portion of the blanket contacting an inner circumferential face of the drum maintains a position thereof so as to continuously contact the inner circumferential face until an end of drying. A portion of the blanket as exposed to a center of the drum maintains a position thereof so as to be continuously exposed to the drum center until the end of drying. Therefore, the large sized laundry may not be dried evenly and entirely. In particular, when the load is bulky laundry, drying of a surface thereof may be effectively performed, but drying of a center portion of the laundry may not be properly performed. Therefore, there is a need to find a way to enable the uniform drying when the laundry is a specific load such as a thick blanket.

Some examples of laundry treating apparatuses for heating a drum and drying an object using an induction heater operate to dry the object while continuously rotating the drum at a tumbling speed at which the object repeatedly rises and falls inside the drum as the drum rotates and, alternately, at a spin speed at which the object rotates integrally with the drum as the drum rotates.

Because the drum is heated, the drum continues to rotate at the tumbling speed and the spin speed alternately. Thus, a time to heat the object may be increased. In this connection, the tumbling operation refers to a drum motion for spreading, rearranging, and mixing the object, while the spin operation refers to a motion for bringing the object into close contact with the drum for enhancing heating performance.

However, when the drum is continuously rotated at the tumbling and spin speeds alternately, the spreading, rearranging, and mixing of the object may not occur efficiently. In particular, this problem may be more noticeable when the laundry is a large sized load such as a blanket and a padding. Further, because the drum operation time increases due to the tumbling motion, the object such as delicate laundry is more likely to be damaged due to a friction or mechanical force.

Some examples of laundry treating apparatuses may change a ratio of the tumbling time duration and a ratio of the spin time duration to a total drum operation time duration according to a type of the object or an amount of the object. This feature may allow the spreading, rearranging, and mixing of the object to be performed efficiently depending on a type of the object or an amount of the object and may improve drying performance. However, as the drum's rotation speed is changed while the drum is continuously rotating, the problems described above persist.

SUMMARY

The present disclosure provides solutions to the problems of the conventional laundry treating apparatus as mentioned above.

In some implementations, the present disclosure provides a laundry treating apparatus having a conductive heating approach using an induction heater to solve the problems of the conventional hot-air based heating dehydration and/or drying approach.

In some implementations, the present disclosure provides a laundry treating apparatus and a method of controlling the same to eliminate drying imbalance and to dry the laundry uniformly. For example, the present disclosure may provide a laundry treating apparatus and a method of controlling the same, in which effective drying may be performed when a large amount of a drying target load is treated.

In some implementations, the present disclosure provides a laundry treating apparatus and a control method thereof, which may minimize the mechanical force generated between the laundry during drying, thereby to reduce shrinkage and deformation of the laundry during drying In some implementations, the present disclosure provides a laundry treating apparatus and a method of controlling the same, that may uniformly and entirely dry a large sized drying target load such as a thick blanket.

In some implementations, the present disclosure provides a laundry treating apparatus and a control method thereof, in which different drum motion cycles are performed based on a condition of a drying target load, thereby ensuring optimum drying performance regardless of the drying condition.

The present disclosure are not limited to the above-mentioned implementations. Other implementations and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

According to one aspect of the subject matter, an object treating apparatus may include a tub, a drum, an induction heater, a motor, and a processor. The drum may be rotatably disposed within the tub and configured to receive an object therein. The induction heater may be disposed on the tub and configured to heat an outer circumferential face of the drum facing the heater. The motor may be configured to rotate the drum. The processor may be configured to control the induction heater to dry the object. The processor may be configured to, during drying the object, operate the drum, by controlling revolutions per minute (RPM) of the drum, in a conductive accelerating motion and a rearrangement motion. In the conductive accelerating motion, the drum may be rotated at a first target RPM that causes the object to rotate integrally with the drum while the object is in contact with an inner circumferential face of the drum. In the rearrangement motion, the drum may be rotated at a second target RPM lower than the first target RPM of the conductive accelerating motion. One embodiment of the present disclosure provides a method for controlling the apparatus.

In these example implementations, the processor may control the drum such that the drum stops for a time duration between temporally-adjacent drum motions (conductive accelerating motion and rearrangement motion) having different target RPMs respectively. The drum rotation directions before and after the stop of the drum are preferably opposite to each other.

In general, in a laundry treating apparatus which performs drying using hot-air, the drum may be operated only using one target RPM (in one example, tumbling motion). Long time tumbling is performed in one direction, and, then, the drum stops, and, then, long time tumbling is performed in the opposite direction. Therefore, a single drum motion cycle may have drum motions having the same target RPM. The drum rotation stops for a time duration between a drum motion cycle and a subsequent drum motion cycle.

According to some implementations of the present disclosure, drum motions having different target RPMs are arranged in a single drum motion cycle. The processor may control the drum such that the drum stops for a time duration between temporally-adjacent drum motions having different target RPMs respectively. This is because drying is performed by heating the drum rather than drying using hot-air, and, thus, laundry spread, laundry rearrangement, and laundry mixing using the drum operation are more important than in the hot air based approach. This is because that, in the present approach, only a portion of the laundry in contact with the inner circumferential face of the drum may be heated in an intense manner. Therefore, in one embodiment of the present disclosure, in order to further facilitate the laundry spread, laundry rearrangement, and laundry mixing, the drum motions having different target RPMs are arranged in the single cycle. The drum stops for a time duration between temporally-adjacent drum motions having different target RPMs respectively, thereby to further facilitate laundry spread, laundry rearrangement, and laundry mixing. Therefore, the single drum motion cycle may include a repeated drum operation having a first target RPM, a repeated drum operation having a second target RPM, and a repeated drum stop performed therebetween.

Implementations according to the aspect may include one or more of the following features. For example, the conductive accelerating motion may include two stages in which the drum is rotated at two different target RPMs respectively, the two different target RPMs including the first target RPM. In this way, laundry spreading and laundry mixing may occur before the load is completely attached to the inner circumferential face of the drum. In addition, the load may be evenly adhered to the inner circumferential face of the drum.

In some implementations, the two different target RPMs of the two stages in the conductive accelerating motion may include a low target RPM that is equal to or greater than a maximum RPM of a tumbling motion of the drum. The two different target RPMs of the two stages in the conductive accelerating motion may include a high target RPM that is higher than a threshold spin RPM at which the drum is rotated to cause the object to come into contact with the drum and begin to rotate integrally with the drum. Based on the threshold spin RPM being in a range of 60 to 70 RPM, the high target RPM of the two different target RPMs of the two stages of the conductive accelerating motion may be in a range of 75 to 85 RPM.

In some implementations, the second target RPM of the rearrangement motion is equal to an RPM of a tumbling motion of the drum at which the drum is rotated to cause the object to rise up and fall down.

In some implementations, the rearrangement motion may include a first stage and a subsequent second stage. The drum may be rotated at a third target RPM in the first stage. The third target RPM is lower than a RPM of a tumbling motion of the drum. The drum may be rotated at a fourth target RPM in the second stage. The fourth target RPM is higher than a minimum RPM of the tumbling motion and lower than or equal to a maximum RPM of the tumbling motion. In some implementations, based on the RPM of the tumbling motion being in a range of 40 to 60 RPM, the third target RPM may be in a range of 25 to 35 RPM lower than the minimum RPM of the tumbling motion, and the fourth target RPM may be equal to 60 RPM as the maximum RPM of the tumbling motion.

In some implementations, the processor may be configured to control the drum to perform a drum motion cycle. The drum motion cycle may include the conductive accelerating motion and the rearrangement motion. The drum motion cycle may include one conductive accelerating motion and two rearrangement motions. During a time between the two rearrangement motions, the drum may be operated to stop and change a direction of rotation of the drum. In some implementations, the two rearrangement motions may include a preceding rearrangement motion and a subsequent rearrangement motion. The preceding rearrangement motion may be performed subsequent to the conductive accelerating motion. A direction of drum rotation in the preceding rearrangement motion may be opposite to a direction of drum rotation in the conductive accelerating motion. A direction of drum rotation in the subsequent rearrangement motion may be opposite to a direction of drum rotation in the preceding rearrangement motion.

In some implementations, based on satisfaction of a condition of a drying target load, the processor is further configured to perform drying using the drum motion cycle. The condition of the drying target load may include at least one of a condition that the drying target load is a delicate load, a condition that the drying target load is a large-sized load, or a condition that the drying target load is a general load. In some implementations, the processor may be configured to determine whether to use the drum motion cycle based on the condition of the drying target load, and perform drying using the drum motion cycle based on determination of the drying target load being the delicate load. In some implementations, the condition of the drying target load may be determined by at least one of: a user course selection, a laundry amount detection before washing, a washing, a dehydration, or a drying option selection.

In some implementations, the processor may be further configured to control the induction heater to operate only when the drum rotates at an RPM equal to or higher than a predefined RPM during drying. The predefined RPM may be higher than 0 RPM and lower than a smallest target RPM in the drum motion cycle.

According to another aspect of the subject matter, an object treating apparatus may include a tub, a drum, an induction heater, a motor, and a processor. The drum may be rotatably disposed within the tub and configured to receive an object therein. The induction heater may be disposed on the tub and configured to heat an outer circumferential face of the drum facing the heater. The motor may be configured to rotate the drum. The processor may be configured to control the induction heater to dry the object, and configured to, during drying the object, operate the drum in a drum motion cycle, the drum motion cycle including a conductive accelerating motion and a subsequent rearrangement motion. In the conductive accelerating motion, the drum may be rotated at a RPM that is higher than a threshold spin RPM. The drum may be rotated at the threshold spin RPM to cause the object to come into contact with the drum and begin to rotate integrally with the drum. In the subsequent rearrangement motion, the drum may be rotated at a target RPM to cause the object to tumble in the drum, wherein the rearrangement motion is repeated. One embodiment of the present disclosure provides a method for controlling the apparatus.

In some implementations, in the drum motion cycle, the rearrangement motion may be performed more frequently than the conductive accelerating motion.

One embodiment of the present disclosure provides an object treating apparatus comprising: a tub; a drum rotatably disposed within the tub and accommodating an object therein; an induction heater disposed on the tub and configured to heat an outer circumferential face of the drum contacting the heater; a motor to rotate the drum; and a processor configured to control an operation of the induction heater to dry the object, wherein the processor is configured to: control revolution per minute (RPM) of the drum to perform at least two drum motions having at least two different target RPMs respectively when drying the object. One embodiment of the present disclosure provides a method for controlling the apparatus.

The drum motions may include a space securing motion having a target RPM greater than a threshold spin RPM, wherein when the drum rotates at the threshold spin RPM, the object comes into close contact with the drum and begins to rotate integrally with the drum.

An empty spaces may be formed in a center region of the drum using the space securing motion. In this empty space, the load may drop, such that the position and posture thereof may change, and the loads may be mixed with each other.

When the threshold spin RPM is in a range of 60 to 70 RPM, the target RPM of the space securing motion is lower than a first resonance RPM of the drum. The target RPM of the space securing motion may be in a range of 90 to 110 RPM.

Therefore, the target RPM of the space securing motion is higher than the spin RPM. The target RPM of the space securing motion is less likely to cause resonance and vibration.

The drum motions includes a rearrangement motion having a target RPM equal to RPM of a tumbling motion, wherein as the drum rotates at the RPM of the tumbling motion, the object rises up and falls down.

The drum motions includes a rearrangement motion having a first stage and a subsequent second stage, wherein the first stage has a first target RPM lower than a RPM of a tumbling motion, wherein the second stage has a second target RPM higher than minimum RPM of the tumbling motion and lower than or equal to maximum RPM of the tumbling motion.

Effective laundry mixing and spread may be performed using rearrangement motion while using the empty space secured using the space securing motion in a maximal degree.

When the RPM of the tumbling motion is in a range of 40 to 60 RPM, the first target RPM is in a range of 25 to 35 RPM lower than the minimum RPM of the tumbling motion, and the second target RPM is equal to 60 RPM as the maximum RPM of the tumbling motion.

A drying process includes a first drum motion cycle in which the space securing motion is performed, and, subsequently, the rearrangement motion is performed in a repeated manner. That is, the space securing motion and rearrangement motion are not performed irregularly. The drum may be operated at a certain pattern or cycle during drying.

The first drum motion cycle includes a single-time space securing motion and double-times rearrangement motions. It is preferable that in the entire first drum motion cycle, an execution time duration of the rearrangement motion is larger than an execution time duration of the space securing motion. When the load is a general load or a load amount is larger, it is preferable that the drying be carried out evenly and entirely across the loads. Therefore, the rearrangement motion may be relatively long and performed more frequently.

For a time duration between the double-times rearrangement motions, the drum stops to change a direction of rotation of the drum.

The drum motions includes a gravity-based drop motion between the space securing motion and double-times rearrangement motions, wherein in the gravity-based drop motion, the drum stops for a longer time than a drum stop time between the double-times rearrangement motions.

In a preceding rearrangement motion of the double-times rearrangement motions, a direction of drum rotation is opposite to a direction of drum rotation in the space securing motion, wherein the preceding rearrangement motion is subsequent to the space securing motion. In a subsequent rearrangement motion of the double-times rearrangement motions, a direction of drum rotation is opposite to a direction of drum rotation in the preceding rearrangement motion.

When a condition of a drying target load satisfies a specific condition, the processor is further configured to perform drying using the first drum motion cycle.

The condition of the drying target load includes a condition that the drying target load is a delicate load, a condition that the drying target load is a large-sized load, and a condition that the drying target load is a general load. That is, drying may be performed using different drum motion cycles based on the determined or input load type.

When the drying target load is the general load, the processor is further configured to perform drying using the first drum motion cycle. When the drying target load is the delicate load, the processor is further configured to perform drying using the second drum motion cycle. When the drying target load is the large sized load, the processor is further configured to perform drying using the third drum motion cycle.

The condition of the drying target load is determined in at least one selected from a group including: a user course selection, a laundry amount detection before washing, a washing, a dehydration, and a drying option selection.

The processor is further configured to control the induction heater to operate only when the drum rotates at RPM equal to or higher than a predefined RPM during drying.

The predefined RPM is higher than 0 RPM and lower than a smallest target RPM in the first drum motion cycle. Therefore, the operation of the induction heater may be started in the accelerating region to minimize overheating of the drum or load while minimizing the reduction in the heating time.

One embodiment of the present disclosure provides an object treating apparatus comprising: a tub; a drum rotatably disposed within the tub and accommodating an object therein; an induction heater disposed on the tub and configured to heat an outer circumferential face of the drum contacting the heater; a motor to rotate the drum; and a processor configured to control an operation of the induction heater to dry the object, wherein the processor is configured to control the drum to perform a first drum motion cycle during drying, wherein the first drum motion cycle includes: a space securing motion having a high RPM in which the object is in close contact with the drum; and a subsequent rearrangement motion having a low RPM in which the object tumbles in the drum, wherein the rearrangement motion is repeated.

In the first drum motion cycle, the rearrangement motion may be performed more frequently than the space securing motion.

In accordance with one embodiment of the present disclosure, the processor may implement at least three drum motions with different target RPMs for drying. The at least three drum motions may include a rearrangement motion, a conductive accelerating motion, and a space securing motion. A target RPM of the rearrangement motion is the smallest, that of the conductive accelerating motion is a middle level, and that of the space securing motion is the largest.

The processor may determine drying conditions and implement different drum motion cycles depending on the drying conditions. Each drum motion cycle may include a combination of at least two of the three motions.

Therefore, the laundry treating apparatus and the control method thereof may be realized in which the optimum drum motion cycle is selected based on the drying condition and drying is executed based on the selected motion cycle, thereby preventing laundry damage and partial insufficient drying or partially excessive drying regardless of the drying condition.

The devices, systems, methods, and techniques described herein may provide one or more of the following advantages (but not limited thereto). For example, some implementations of the present disclosure may provide a laundry treating apparatus having a conductive heating approach using an induction heater to solve the problem of the conventional hot-air based heating dehydration and/or drying approach.

Further, some implementations of the present disclosure may provide a laundry treating apparatus and a method of controlling the same to eliminate drying imbalance and to dry the laundry uniformly. In particular, the present disclosure may provide a laundry treating apparatus and a method of controlling the same, in which effective drying may be performed when a large amount of a drying target load is treated.

Moreover, some implementations of the present disclosure may provide a laundry treating apparatus and a control method thereof, which may minimize the mechanical force generated between the laundry during drying, thereby to reduce shrinkage and deformation of the laundry during drying.

In addition, some implementations of the present disclosure may provide a laundry treating apparatus and a method of controlling the same, that may uniformly and entirely dry a large sized drying target load such as a thick blanket.

Further, some implementations of the present disclosure may provide a laundry treating apparatus and a control method thereof, in which different drum motion cycles are performed based on a condition of a drying target load, thereby ensuring optimum drying performance regardless of the drying condition.

Advantages of the present disclosure are not limited to the above effects. Those skilled in the art may readily derive various effects of the present disclosure from various configurations of the present disclosure.

DETAILED DESCRIPTION

Figure 1:
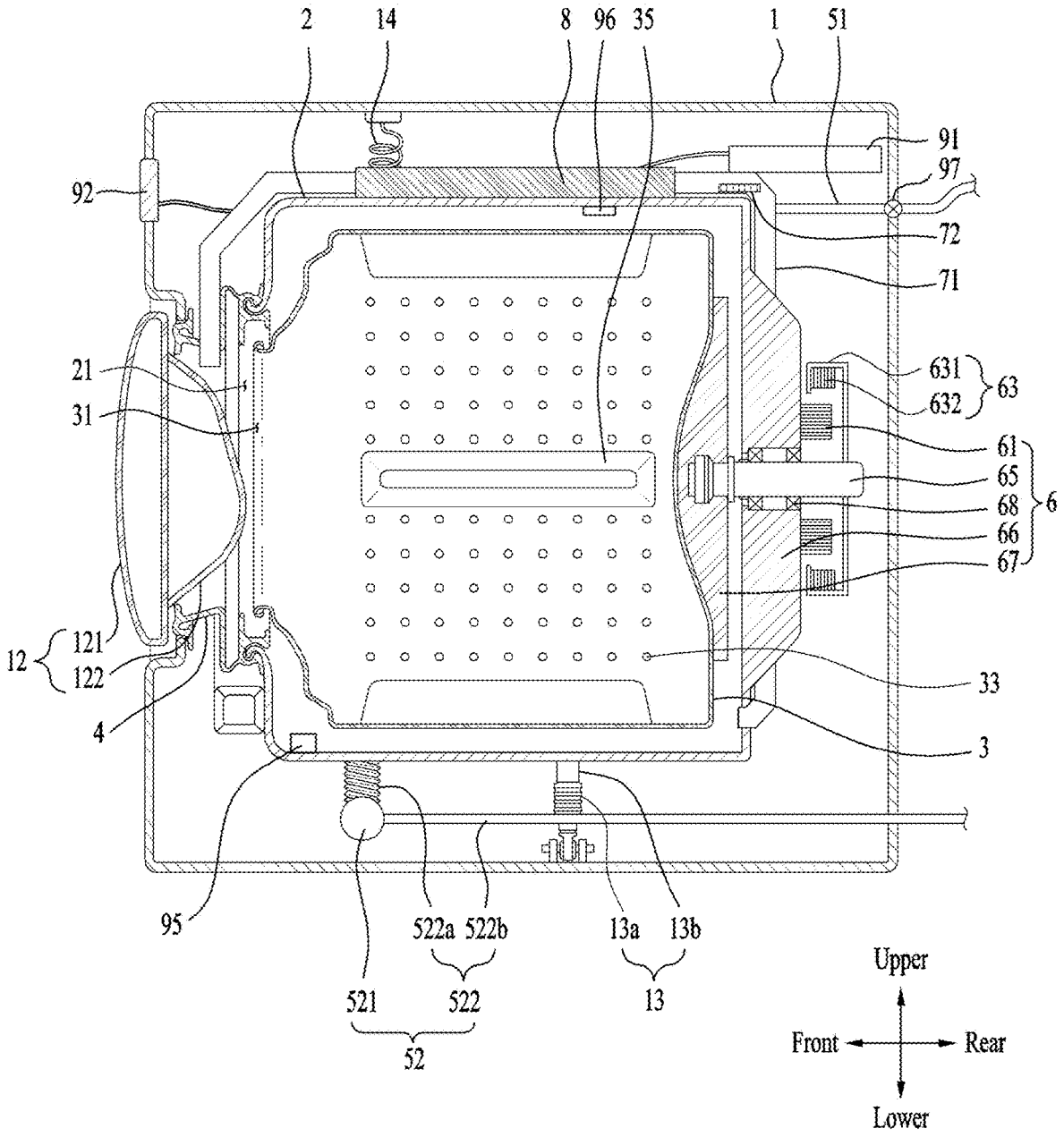
FIG. 1 shows a cross section of a laundry treating apparatus according to one embodiment of the present disclosure.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, with reference to FIG. 1, a laundry treating apparatus according to one embodiment of the present disclosure will be described.

The laundry treating apparatus according to one embodiment of the present disclosure includes a cabinet 1 forming an appearance, a tub 2 disposed inside the cabinet, and a drum 3 rotatably disposed inside the tub 2 and containing an object (in one example, washing target, drying target, or refreshing target). In one example, when washing the laundry using washing-water, the object may be referred to as a washing target. When wet laundry is dried using heat, the object may be referred to as a drying target. When dry laundry is refreshed using hot-air, cold wind or steam, the object may be referred to as a refreshing target. Therefore, the washing, drying or refreshing of the laundry may be performed using the drum 3 of the laundry treating apparatus.

The cabinet 1 may have a cabinet opening defined in a front face of the cabinet 1. The object may enter and exit the drum through the cabinet opening. The cabinet 1 may be equipped with a door 12 pivotally mounted to the cabinet to open and close the opening.

The door 12 may be composed of an annular door frame 121 and a transparent glass 122 disposed in a center of the door frame.

In this connection, when defining a direction to help understand the detailed structure of the laundry treating apparatus to be described below, a direction from a center of the cabinet 1 towards the door 12 may be defined as a front direction.

Further, an opposite direction to the front direction towards the door 12 may be defined as a rear direction. A right direction and a left direction may naturally be defined depending on the front and rear directions as defined above.

The tub 2 is cylindrically shaped with a longitudinal axis thereof being parallel to a bottom face of the cabinet or maintained to be tilted at 0 to 30° relative to the bottom face. The tub 2 has an inner space in which water may be stored. A tub opening 21 is defined in a front face of the tub to communicate with the cabinet opening.

The tub 2 may be secured to the bottom face of the cabinet via a lower support 13 including a support bar 13*a* and a damper 13*b* connected to the support bar 13*a*. Accordingly, vibration generated from the tub 2 may be attenuated by rotation of the drum 3.

Further, a top face of the tub 2 may be connected to an elastic support 14 fixed to a top face of the cabinet 1. This configuration may act to dampen the vibration generated in the tub 2 and then transmitted to the cabinet 1.

The drum 3 has a cylindrical shape whose longitudinal axis is parallel to the bottom face of the cabinet or is tilted at 0 to 30° relative to the bottom face. The drum contains the object. A front face of the drum 3 may have a drum opening 31 defined therein in communication with the tub opening 21. An angle between a center axis of the tub 2 and the bottom face of the cabinet may be equal to an angle between a center axis of the drum 3 and the bottom face.

Further, the drum 3 may include multiple through-holes 33 penetrating the outer circumferential face thereof. The washing-water and air may communicate between the inside of the drum 3 and the inside of tub 2 using the through-holes 33.

A lifter 35 for stirring the object when the drum rotates may be disposed on the inner circumferential face of the drum 3. The drum 3 may be rotated by a driver 6 placed behind the tub 2.

The driver 6 may include a stator 61 fixed to a back fade of the tub 2, a rotor 63 that rotates via electromagnetic action with the stator 61, and a rotation shaft 65 passing through the back face of the tub 2 and connecting the drum 3 and rotor 63 with each other.

The stator 61 may be fixed to a rear face of a bearing housing 66 disposed on the back face of the tub 2. The rotor 63 may include a rotor magnet 632 disposed radially outwardly of the stator, and a rotor housing 631 connecting the rotor magnet 632 and the rotation shaft 65 with each other.

The bearing housing 66 may contain a plurality of bearings 68 which support the rotation shaft 65. Further, a spider 67 to easily transfer the rotational force of the rotor 63 to the drum 3 may be disposed on the rear face of the drum 3. The rotation shaft 65 may be fixed to the spider 67 and may transmit a rotational power of the rotor 63.

In one example, the laundry treating apparatus according to an embodiment of the present disclosure may further include a water supply hose 51 supplied with water from the outside. The water hose 51 forms a water supply channel to the tub 2.

Further, a gasket 4 may be provided between the opening of the cabinet 1 and the tub opening 21. The gasket 4 prevents leakage of water inside the tub 2 into the cabinet 1 and prevents transmission of vibration from the tub 2 into the cabinet 1.

In one example, the laundry treating apparatus according to an embodiment of the present disclosure may further include a water discharger 52 for discharging water inside the tub 2 to the outside of the cabinet 1.

The water discharger 52 may include a water discharge pipe 522 which forms a drainage channel along which the water inside the tub 2 flows, and a water discharge pump 521 which generates a pressure difference inside the water discharge pipe 522 such that the water is drained through the water discharge pipe 522.

More specifically, the water discharge pipe 522 may include a first water discharge pipe 522*a* connecting a bottom face of the tub 2 and the water discharge pump 521 to each other, and a second water discharge pipe 522*b* having one end connected to the water discharge pump 521 to form a channel through which water flows out of the cabinet 1.

Further, the laundry treating apparatus according to an embodiment of the present disclosure may further include a heater 8 for induction-heating the drum 3.

The heater 8 is mounted on a circumferential face of the tub 2. The heater may execute induction heating of a circumferential face of the drum 3 using a magnetic field generated when applying current to a coil as a wire winding. Thus, the heater may be referred to as an induction heater. When the induction type heater is operated, the outer circumferential face of the drum facing the induction heater 8 may be heated to very high temperatures in a very short time.

The heater 8 may be controlled by a controller 9 fixed to the cabinet 1. The controller 9 controls a temperature inside the tub by controlling the operation of the heater 8. The controller 9 may include a processor for controlling an operation of the laundry treating apparatus. The controller may include an inverter processor that controls the heater. That is, the operation of the laundry treating apparatus and the operation of the heater 8 may be controlled using one processor.

However, in order to improve control efficiency and prevent overloading of the processor, a general processor controlling the operation of the laundry treating apparatus and a special purpose processor controlling the heater may be separately provided and may be communicatively connected to each other.

A temperature sensor 95 may be placed inside the tub 2. The temperature sensor 95 may be connected to the controller 9 and communicate an internal temperature information of the tub 2 to the controller 9. In particular, the temperature sensor 95 may be configured to sense a temperature of washing-water or humid air. Therefore, this sensor 95 may be referred to as a washing-water temperature sensor.

The temperature sensor 95 may be placed near an inner bottom face of the tub. Thus, the temperature sensor 95 may be located at a lower level than a level of a bottom of the drum. FIG. 1 shows that the temperature sensor 95 is configured to contact the bottom of the tub. However, it is desirable that the sensor 95 is spaced, by a predetermined distance, away from the bottom face of the tub. This spacing allows the washing-water or air to surround the temperature sensor so that the washing-water or air temperature may be accurately measured. In addition, the temperature sensor 95 may be mounted so as to penetrate the tub from a bottom of the tub to a top thereof. In another example, the sensor 95 may be mounted so as to penetrate the tub from a front face of the tub to a rear face thereof. That is, the sensor 95 may be mounted to pass through a front face (the face having the tub opening defined therein) rather than a circumferential face of the tub.

Thus, when the laundry treating apparatus heats the washing-water using the induction heater 8, the temperature sensor may detect whether the washing-water is heated up to a target temperature. The operation of the induction heater may be controlled based on the detection result of the temperature sensor.

Further, when the washing-water is completely drained, the temperature sensor 95 may detect the air temperature. Because remaining washing-water or cooling water remains on the bottom of the tub, the temperature sensor 95 senses a temperature of humid air.

In one example, the laundry treating apparatus according to an embodiment of the present disclosure may include a drying temperature sensor 96. The drying temperature sensor 96 may differ from the above-described temperature sensor 95 in terms of an installation position and a temperature measurement target. The drying temperature sensor 96 may detect a temperature of the air heated using the induction heater 8, that is, a drying temperature. Therefore, whether or not the air is heated to the target temperature may be detected using the temperature sensor. The operation of the induction heater may be controlled based on the detection result of the drying temperature sensor.

The drying temperature sensor 96 may be located on a top of the tub 2 and placed adjacent to the induction heater 8. That is, the sensor 96 may be disposed on the inner face of tub 2 while the induction heater 8 is disposed on an outer face of the tub 2. The sensor 96 may be configured to detect a temperature of an outer circumferential face of the drum 3. The above-described temperature sensor 95 may be configured to detect the temperature of the surrounding water or air. The drying temperature sensor 96 may be configured to detect the temperature of the drum or a drying air temperature around the drum.

Because the drum 3 is rotatable, the drying temperature sensor 96 may detect a temperature of air near the outer circumferential face of the drum 30 to indirectly detect the temperature of the outer circumferential face of the drum.

The temperature sensor 95 may be configured to determine whether to continue the operation of the induction heater until the target temperature is achieved or to determine whether to vary an output of the induction heater. The drying temperature sensor 96 may be configured to determine whether the drum is overheated. Upon determining that the drum is overheated, a controller may forcibly terminate the operation of the induction heater.

In addition, the laundry treating apparatus according to an embodiment of the present disclosure may have a drying function. In this case, the laundry treating apparatus according to one embodiment of the present disclosure may be referred to as a drying and washing machine. For this purpose, the apparatus may further include a fan 72 for blowing air into the tub 2, and a duct 71 having the fan 72 mounted therein. In another example, the apparatus may perform the drying function even when those components are not additionally present. That is, the air may be cooled and the water may be condensed on the inner circumferential face of the tub and then may be discharged. In other words, drying may be carried out by the condensation of the water itself even without air circulation. Cooling water may be supplied into the tub to improve the water condensation and improve the drying efficiency. The larger a contact surface area where the cooling water and the tub contact each other, that is, a contact surface area where the cooling water and the air contact with each other, better the drying efficiency. To this end, the cooling water may be supplied as the cooling water spreads widely across the back face of the tub or one side face or both side faces of the tub. This cooling water supply scheme may allow the cooling water to flow along the inner surface of the tub to prevent the cooling water from entering the drum. Therefore, the component such as the duct or fan may be omitted for the drying, thereby making it very easy to manufacture the apparatus.

In this connection, there is no need to provide a separate heater for drying. That is, the drying may be performed using the induction heater 8. That is, all of washing-water heating at washing, object heating at dehydration, and object heating at drying may be performed using a single induction heater.

When the drum 3 operates and the induction heater 8 operates, an entire outer circumferential face of the drum may heat up. The heated drum exchange heat with wet laundry and heats the laundry. In another example, air inside the drum may be heated. Therefore, when the air is supplied to the inside of the drum 3, the air has evaporated away moisture from the laundry via heat exchange and then the cooled air may be discharged to the outside of the drum 3. That is, air may circulate between the duct 71 and drum 3. In another example, the fan 72 will be operated for air circulation.

A position into which air is supplied and a position from which air is discharged may be determined so that the heated air may be evenly supplied to the drying target and humid air may be smoothly discharged. For this purpose, air may be supplied onto a front and top position of the drum 3, while the air may be discharged from a rear and bottom position of the drum 3, that is, a rear and bottom position of the tub.

After the air is discharged from a rear and bottom position of the drum 3, that is, a rear and bottom position of the tub, the air flows along the duct 71. In the duct 71, moisture in humid air may condense due to condensate water supplied into the duct 71 through a condensate water channel 51. When the moisture in humid air condenses, the air is converted to cold dry air. This cold dry air may flow along the duct 71 and be fed back into the drum 3.

Thus, because this system does not directly heat the air itself, a temperature of the heated air may be lower than a temperature of air heated using a typical heater type dryer. Therefore, effect of preventing damage or deformation of the laundry due to a high temperature may be expected. In another example, the laundry may be overheated while the laundry contacts the drum heated to a high temperature.

As described above, however, as the drum is operated, the induction heater is operated. The laundry is repeatedly moved up and down as the drum is operated. A lower portion of the drum is not heated but an upper portion of the drum is heated. Thus, this approach may effectively prevent the laundry from being overheated.

A control panel 92 may be disposed on a front or top face of the laundry treating apparatus. The control panel may act as a user interface. A user may input various inputs onto the control panel. Various information may be displayed on the control panel. That is, a manipulator for user manipulation and a display for displaying information to the user may be disposed on the control panel 92.

Figure 2:
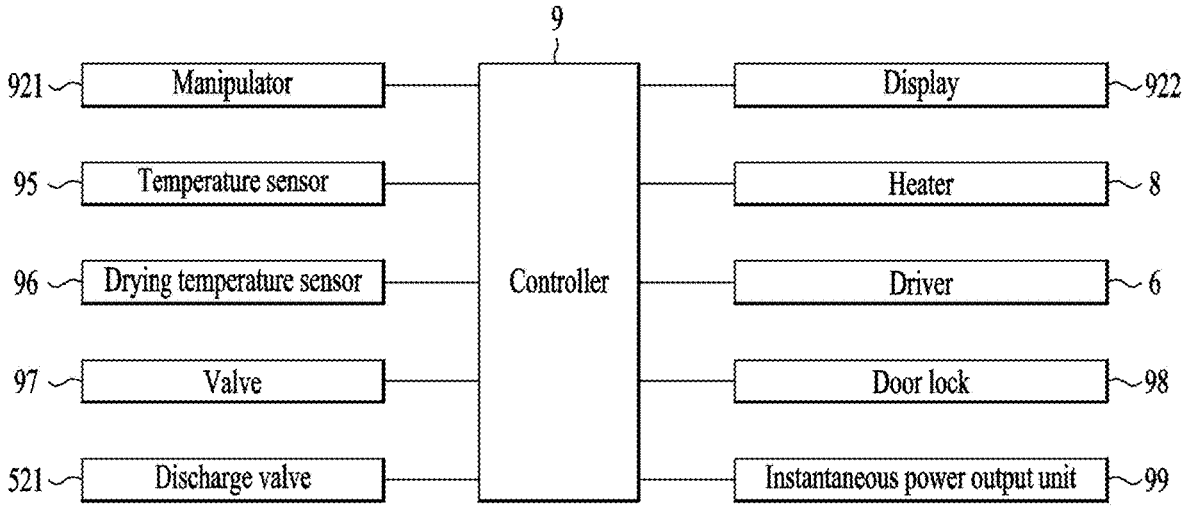
FIG. 2 shows a block diagram of a control configuration of a laundry treating apparatus according to one embodiment of the present disclosure.

FIG. 2 shows a systematic block diagram of a laundry treating apparatus according to one embodiment of the present disclosure.

The controller 9 may control an operation of the induction heater 8 based on detection results of the temperature sensor 95, and the drying temperature sensor 96. The controller 9 may control an operation of a driver 6 which drives the drum using a motor and control operations of various sensors and hardware. The controller 9 may control various valves and pumps for water supply, drainage, and cooling water supply, and may control the fan.

In particular, according to the present embodiment, the apparatus may include a cooling water valve 97 for converting a high temperature and high humidity air/environment to a low temperature dry air/environment. The cooling water valve 97 may allow cold water to be fed into the tub or into the duct to cool air therein to condense moisture in the air.

During dehydration and/or cooling water supply, the discharge pump 421 may be operated periodically or intermittently.

According to this embodiment, the apparatus may include a door lock 98. The door lock may refer to as a door locking device to prevent a door from being opened during operation of the laundry treating apparatus. According to this embodiment, the door opening may be prohibited when an internal temperature is higher than a preset temperature not only during an operation of the laundry treating apparatus but also after an operation of the laundry treating apparatus is completed.

Further, the controller 9 may control various displays 922 disposed on the control panel 92. Further, the controller 9 may receive signals from various manipulators 921 disposed on the control panel 92 and may control all operations of the laundry treating apparatus based on the signals.

In one example, the controller 9 may include a main processor that controls a general operation of the laundry treating apparatus and an auxiliary processor that controls an operation of the induction heater. The main processor and the auxiliary processor may be separately disposed and may be communicatively connected to each other.

According to one embodiment of the present disclosure, the controller may vary an output of the induction heater. The controller may increase the output of the induction heater as much as possible within an acceptable condition or range, thereby to reduce a heating time such that a maximum effect may be obtained. To this end, in this embodiment, an instantaneous power output unit 99 may be included in the apparatus. Details thereof will be described later.

Hereinafter, with reference to FIG. 3 and FIG. 4, a method for controlling a laundry treating apparatus in accordance with one embodiment of the present disclosure, in particular, a drum operation pattern, that is, a drum motion during drying will be described in detail.

In this embodiment, a circumferential face of the drum is heated using the induction heater. Therefore, when a load (drying target) is in continuous close contact with the inner circumferential face of the drum during heating of the drum, drying imbalance of an entirety of the load, partial excessive heating of the load, or partial excessive drying of the load may occur. Conventionally, drying is performed using a drum tumbling motion in a range of 40 to 60 RPM. In this case, a laundry mixing or laundry spreading value is small, so that hot-air may be supplied to a center space of the drum insufficiently, and thus various types of drying qualities may be deteriorated.

In order to solve this problem, in the present embodiment, a drying quality may be improved by changing a drum motion during drying to maximize the laundry spreading and laundry mixing values.

Specifically, according to this embodiment, a plurality of drum operation motions may be combined with each other to achieve drum inner-space securing due to compression of the load, drop and position change of the load, and spatial movement of the load to allow the load to be evenly mixed and spread, thereby to provide an optimal drying quality. In other words, a combination of the plurality of drum motions instead of using a single drum motion may solve the drying imbalance and partial excessive drying.

In order to secure a space in which loads may be moved inside the drum, a space securing motion may be performed.

The space securing motion may be referred to as a motion in which the drum rotates at a higher RPM than a RPM in a tumbling motion (40 to 60 RPM) in which the load repeatedly rises up and falls down as the drum rotates. That is, the space securing motion may be referred to as a motion in which the drum rotates at a higher RPM than RPM in a spin motion in which the drum and the load rotate integrally. Thus, this space securing motion may allow the load to closely adhere to the inner circumferential face of the drum due to a centrifugal force. In one example, when a threshold spin RPM is 60 to 70 RPM, the space securing motion may have a target RPM of about 90 to 110 RPM. For convenience of descriptions, the target RPM of the space securing motion may be 100 RPM.

In the space securing motion, the load is pressed against an inner surface of the drum, and is compressed due to a centrifugal force, and is rotated integrally with the drum. However, the space securing motion is different from a dehydration motion which removes moisture from the load due to the centrifugal force. The dehydration motion may be referred to as a motion of rotating the drum at approximately 600 RPM or greater. Therefore, in the space securing motion, partial water may be removed due to the centrifugal force. However, water of an amount larger than a certain amount is not removed.

In this connection, approximately 100 RPM may be referred to as a lower RPM than a RPM corresponding to a resonance band of the laundry treating apparatus. A low-band (first) resonance of the laundry treating apparatus may occur at about 200 RPM. The space securing motion in the present embodiment may be referred to as a motion of rotating the drum at a lower RPM than the RPM corresponding to the low-band resonance. Thus, accelerating and deceleration of the drum may facilitate the space securing motion. In other words, instead of multi-ranges accelerating and decelerating of the drum, the drum accelerates from a stop state to a target space securing motion RPM by a single range, and, then, the drum rotates for a predefined time duration at the space securing motion RPM, and, then, the drum decelerates back to the stop state by a single range. The drum motion from a start of the above drum operation to a stop of the drum operation may be referred to as the space securing motion.

Figure 3:
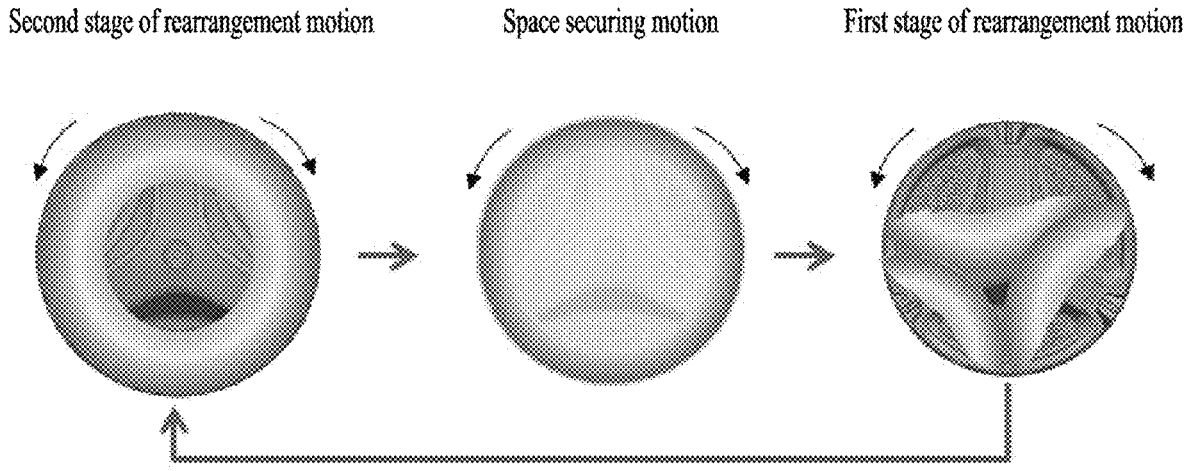
FIG. 3 shows an example of a drum motion cycle during drying according to one embodiment of the present disclosure.

As shown in FIG. 3, because the load is in close contact with the inner circumferential face of the drum in the space securing motion, an empty space may be sufficiently secured in the drum inner-space. In other words, the space securing motion may allow the sufficient space to be secured such that the load moves to the center of the drum.

When the space securing motion ends, the drum may remain in a stopped state for a predefined time. That is, when the drum stops, the load drops through the secured space. In the fall process of the load, a posture and a position of the load are changed. A stopped state of the drum between general tumbling motions may act to change a rotation direction of the drum. Therefore, it is preferable in the present embodiment that the stopped state of the drum after the space securing motion ends is maintained for a longer time than a drum stop time between the general tumbling motions. This is because a time enough for the load adhered to the drum to drop by gravity is required. This drum stop motion may be referred to as a gravity-based drop motion and may be distinguished from a conventional drum stop motion.

In this connection, the RPM of the above-mentioned space securing motion is more important in order for the load to fall in the gravity-based drop motion. It is because, when the RPM of the space securing motion is larger than approximately 100 RPM and increases to around 200 RPM, or to a RPM higher than 200 RPM, the load is more stuck to the inner circumferential face of the drum, thereby making it difficult to drop the load by the gravity. In other words, the load is more stuck to the inner circumferential face of the drum and thus form a single large ring shape. Thus, it is not easy to destroy coupling between the loads by the gravity alone.

When a load movement occurs in the gravity-based drop motion through the space secured in the space securing motion, a drum motion for mixing and rearrangement of the load is preferably performed. This durum motion may be referred to as a rearrangement motion. In another example, the rearrangement motion may refer to an additional motion in which the load that may not fall in the gravity-based drop motion drops.

The rearrangement motion may be the same as the general tumbling motion. That is, in the rearrangement motion, the load may repeatedly rise up and fall down while rolling inside the drum. A target RPM of this rearrangement motion may have approximately 40 to 60 RPM. The rearrangement motion may be performed by repeating a process multiple times in which the drum rotates in one direction, then, the drum stops, and then, the drum rotates in an opposite direction. A single-time execution time of the rearrangement motion may be constant over time.

However, the rearrangement motion in the present embodiment may have two stages with different target RPMs. That is, after accelerating the drum to a low speed target RPM, the drum may be rotated for a predefined time at the lower speed RPM (first stage of the rearrangement motion). Then, after accelerating the drum to a high speed target RPM, the drum may be rotated for a predefined time at the high speed RPM (second stage of the rearrangement motion). Then, the drum may decelerate to a stop state. In this connection, the low speed target RPM may be about 25 to 35 RPM, while the high speed target RPM may be about 60 RPM. In another example, the RPM of the rearrangement motion may be somewhat lower than maximum RPM in the tumbling motion. When considering that the RPM of the tumbling motion is approximately 40 to 60 RPM, the rearrangement motion may be performed such that the drum rotates at a lower RPM than the RPM of the tumbling motion and then immediately, the drum rotates at a RPM close to the maximum RPM of the tumbling motion.

In this connection, the low speed RPM stage in the rearrangement motion may be the first stage of the rearrangement motion to agitate the load that may be stuck to the inner circumferential face of the drum to allow the load to drop through the secured space. Afterwards, the high-speed RPM stage may be the second stage of the rearrangement motion in which the loads may rearranged and be mixed evenly with each other inside the drum. In other words, in the second stage of the rearrangement motion, the strongest tumbling motion may be performed while removing the spin motion.

The rearrangement motion may be performed multiple times. In this connection, forward and reverse rotations may be repeated. As shown in FIG. 4, the drum is stopped for an duration between adjacent rearrangement motions to change a direction of rotation of the drum. In this connection, the time duration is preferably shorter than a time duration as required in the aforementioned gravity-based drop motion. The rearrangement motion may be performed twice in the forward and reverse directions respectively. After the rearrangement motion is terminated, a subsequent space securing motion may be performed.

The drum stop time between the rearrangement motion and the subsequent space securing motion may be the same as the drum stop time between the adjacent rearrangement motions. Further, the drum stop time between the rearrangement motion and the subsequent space securing motion may be shorter than the time required for the gravity-based drop motion. However, a drum stop motion between the space securing motion and the subsequent rearrangement motion may be referred to as a gravity-based drop motion. Therefore, a drum stop time between the space securing motion and the subsequent rearrangement motion may be longer than the drum stop time between the rearrangement motion and the subsequent space securing motion.

Therefore, in the present embodiment, the drum operation and the drum RPM may be controlled to perform at least two drum motions having at least two different target RPMs respectively during drying. In one example, drying may be performed in the space securing motion and rearrangement motion.

According to this embodiment, the space is secured inside the drum. The position of the load changes while the load moves in the secured space. In the secured space, the loads roll and mix with each other and spread. In particular, when performing the rearrangement motion in multiple stages having different target RPMs respectively, the effect of the space securing motion may be fully utilized.

Each of the space securing motion, the gravity-based drop motion, and the rearrangement motion may be repeated a plurality of times. One space securing motion, one gravity-based drop motion, and two rearrangement motions may constitute one cycle. A drying process may be performed by repeating this cycle a plurality of times. Therefore, this single cycle of the drum motions may be referred to as a first drum motion cycle of the drying process.

In another example, the controller may perform a rearrangement motion as a last drum motion in the drying process and stops the drum. This is because at an end of the drying process, entanglement of the load may be removed and the load may drop to the bottom of the drum and thus the load may be easily pulled out of the drum by the user.

Figure 4:
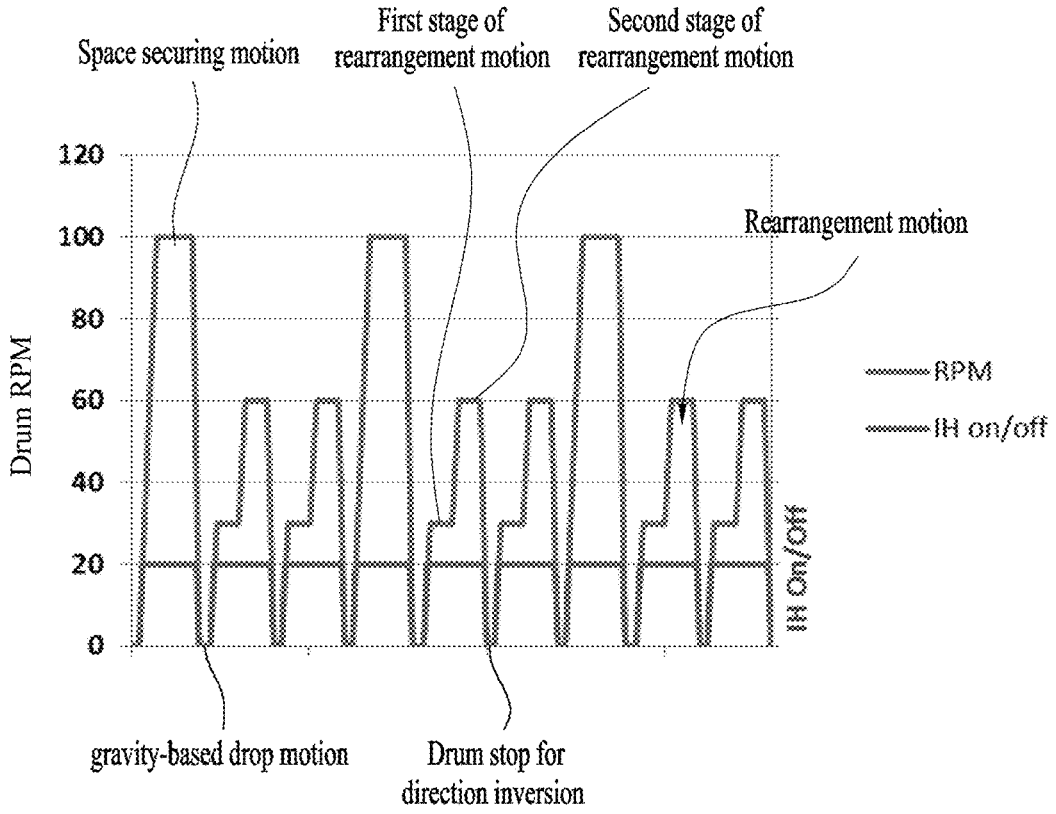
FIG. 4 shows an example of drum RPM change and induction heater operation control in a space securing motion and a rearrangement motion shown in FIG. 3.

As shown in FIG. 4, an operation of the induction heater is preferably associated with an operation of the drum. That is, it is preferable to operate the induction heater only in a temporal region in which the drum rotates. Further, it is desirable to ensure that the induction heater operates only in a temporal region where the drum rotates at a RPM above a predefined RPM. In other words, when the drum is accelerated to a RPM higher than or equal to the predefined RPM, the induction heater may be operated and then drum acceleration may be continued. When the drum is decelerated to a RPM below the predefined RPM, the controller may stop the induction heater and stop the drum. In one example, the operation of the induction heater may be performed only when the drum RPM is in a range of about 15 to 25 RPM or greater. More specifically, the controller may set approximately 20 RPM to the predefined RPM so that the induction heater operates only when the drum RPM is 20 RPM or greater than 20 RPM.

The operation of the induction heater when the drum RPM is much lower than the target RPM may cause the partial excessive heating of the drum. This is because a relatively long time is required for an upper portion of the drum to be heated by the induction heater and then for the drum to rotate such that the upper portion contacts the load. The operation of the induction heater when the drum RPM is a very high RPM close to the target RPM may lead to a reduction in heating time, which is undesirable. This is because when an amount of heat to be supplied is constant, a heat supply time becomes longer.

Thus, according to this embodiment, in one example, the controller may control the induction heater to operate when the drum RPM is 20 RPM lower than approximately 30 RPM as a target RPM of the first stage of the rearrangement motion. The controller may stop the operation of the induction heater when the drum RPM decreases from the target RPM to 20 rpm, and then stop the drum. That is, when setting an RPM lower than the lowest target RPM in the first drum motion cycle as RPM corresponding to the induction heater operation, the induction heater may start the operation when the drum is accelerated. This may minimize the reduction in heating time while prevent overheating of the drum.

The first drum motion cycle as described above is suitable for drying of a general load. That is, the first drum motion cycle is suitable for drying a large amount of a load such as socks, T-shirts or pants. In other words, the first drum motion cycle may be suitable for drying many kinds of laundry. This is because when many kinds of laundry are treated, laundry spread and laundry mixing are not properly performed, such that excessive drying may occur in one specific kind of laundry whereas insufficient drying may occur in another specific kind of laundry.

Therefore, it is preferable that in the entire execution time of the first drum motion cycle, the execution time of the rearrangement motion is larger than that of the space securing motion. Each of the single-time execution time duration of the rearrangement motion and the single-time execution time duration of the space securing motion may be the same as each other. Alternatively, the single-time execution time duration of the rearrangement motion may be slightly longer than the single-time execution time duration of the space securing motion.

In general, when drying a load using the tumbling motion, loads may rub against each other and thus friction may occur. Further, the loads are entangled with each other, thereby causing shrinkage/pulling of the load. Thus, a large mechanical force may be applied to the load. This will cause the damage to the load during the drying process.

Accordingly, in the present embodiment, a second drum motion cycle may be provided to prevent the damage to the load and to improve drying performance. In particular, according to the present embodiment, delicate laundry which is easily damaged during drying may be dried at a minimal damage thereof.

Figure 5:
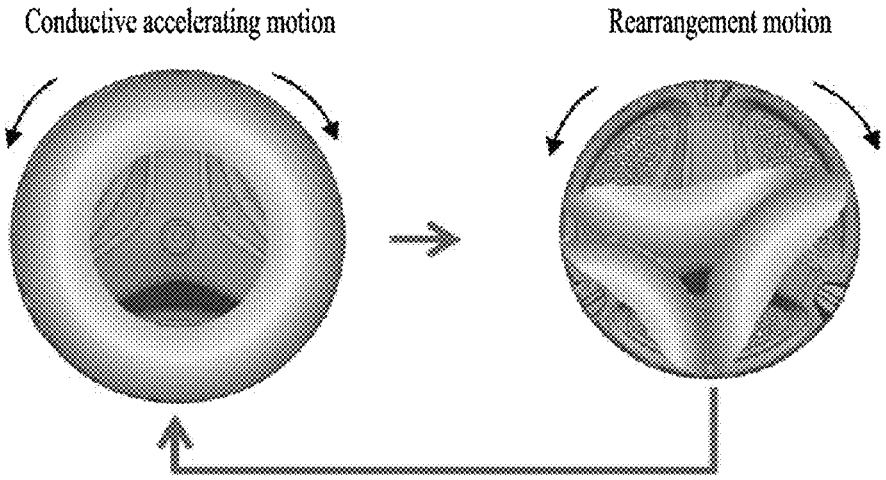
FIG. 5 shows an example of a drum motion cycle during drying according to another embodiment of the present disclosure.
Figure 6:
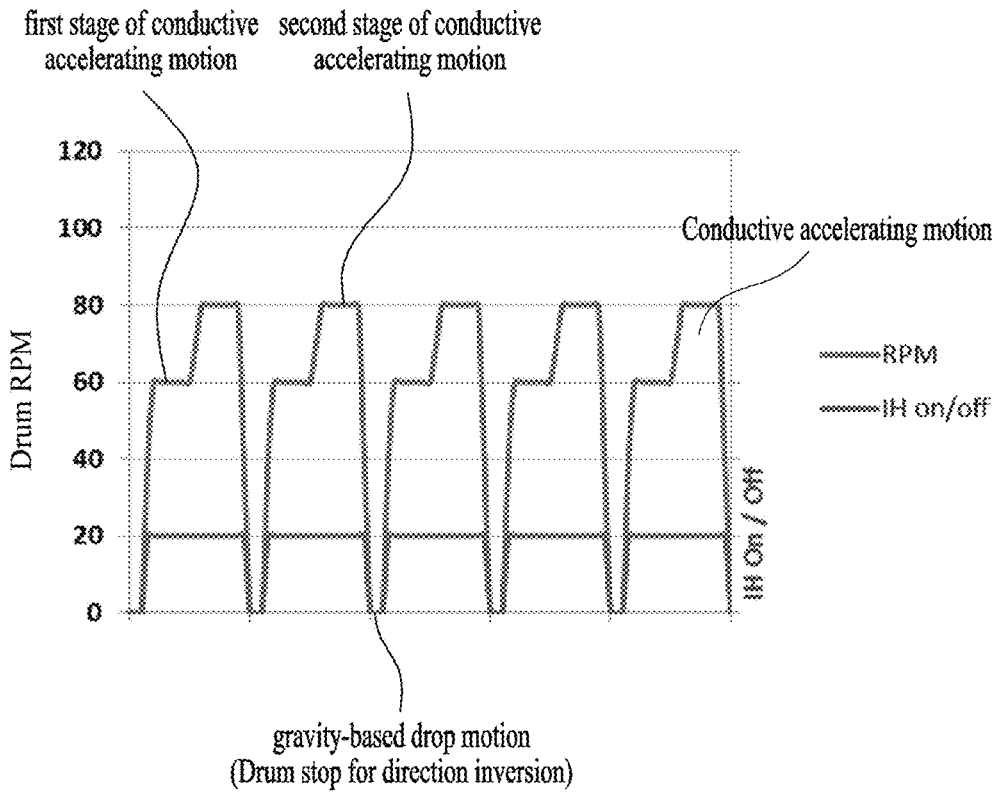
FIG. 6 shows an example of drum RPM variation, and operation control of an induction heater in a conductive accelerating motion shown in FIG. 5.

Hereinafter, this embodiment will be described in detail with reference to FIGS. 5 and 6.

In this embodiment, the drum motion may include a conductive accelerating motion. A drum RPM in the conductive accelerating motion is higher than the RPM of the tumbling motion and is lower than the RPM of the space securing motion as described above.

During the tumbling operation, the load may have a movement a pattern of repeated rise up and fall down without changing a posture of the load. In one example, when assuming an elliptic shaped load, as the drum rotates in a clockwise direction, the elliptical load rises up and then falls down while a bottom face and a left side face of the elliptical load contact the inner circumferential face of the drum. Therefore, a right side face and a top face of the elliptic load do not contact the inner circumferential face of the drum. As the drum rotates in a counterclockwise direction, the elliptical load rises up and then falls down while the bottom face and the right side face of the elliptic load contact the inner circumferential face of the drum. Therefore, the left side face and top face of the elliptic load do not contact the inner circumferential face of the drum.

As a result, when drying the object using the tumbling motion, non-uniform heat transfer distribution around the center of the load may occur. That is, the load has non-uniform heat transfer distribution in a centrifugal direction. Such a load may be relatively lightweight and delicate laundry.

In addition, light and delicate laundry may be vulnerable to friction and mechanical force generated between laundry during the tumbling motion. Thus, for the light and delicate laundry, the drying imbalance and laundry damage may occur.

The conductive accelerating motion may bring the load into close contact to the inner circumferential face of the drum to eliminate the uneven heat transfer in the centrifugal direction. In other words, the conductive accelerating motion may spread the load thinly, such that the entire load may be evenly adhered to the inner circumferential face of the drum to receive heat from the drum. Because the load rotates integrally with the drum while being in close contact with the inner circumferential face of the drum, the friction and mechanical force between the loads may be reduced. As the load rotates in close contact with the heated drum, the heating performance of the load may be higher than that in the tumbling motion.

In the conductive accelerating motion, the controller may be configured to rotate the drum at approximately 80 RPM. In other words, the RPM of the conductive accelerating motion may be higher than RPM of the tumbling motion and may be set such that the load may be rotated integrally with the drum while being in close contact with the inner circumferential face of the drum. The space securing motion as described above brings the load into closer contact with the inner circumferential face of the drum, thereby to generate a tension force as the load is pressed and spread by the centrifugal force. Therefore, as the centrifugal force becomes larger, the tensile force applied to the load itself may damage the load.

Therefore, the conductive accelerating motion may be referred to as a motion in which the RPM between the RPMs of the tumbling motion and the space securing motion is used such that the tensile force applied to the load is minimized while bringing the load into close contact with the inner circumferential face of the drum.

Because the load is in close contact with the inner circumferential face of the drum and thus rotates integrally with the drum, conductive heating efficiency may be increased. Further, friction and entanglement between loads may be minimized. Therefore, effective drying may be performed and the load damage may be minimized.

In this connection, the conductive accelerating motion may include a first stage in which the drum is accelerated to approximately 60 RPM as the maximum tumbling RPM and then keeps rotating for a predefined time. The conductive accelerating motion may include a second stage immediately after the first-stage, in which the drum accelerates to 80 RPM and then keeps rotating for a predefined time. This is because when the drum is rapidly accelerated to 80 RPM immediately after the drum is stopped, the load may be in close contact with the inner circumferential face of the drum while the load is positionally biased in the drum. When using the conductive accelerating motion including the two-stages acceleration, the load may be evenly spread on the inner circumferential face of the drum and be in close contact with the inner circumferential face of the drum.

However, excessive drying may occur on one face of the spread load while insufficient drying may occur on the other face thereof. Therefore, in the present embodiment, the drum motions may include the rearrangement motion as in the above-described embodiment. The rearrangement motion may be the same as in the above-described embodiment. That is, the rearrangement motion may refer to a general tumbling motion. More preferably, the rearrangement motion may include the first stage and the second stage.

In the conductive accelerating motion, the load may be stuck to the inner circumferential face of the drum. The first stage of the rearrangement motion may be used to induce a drop of the load. In addition, when using the second stage of the rearrangement motion, the rearrangement of the load may be accomplished by effectively changing the position and posture of the load.

In this embodiment, one conductive accelerating motion and two rearrangement motions may define one cycle. This one cycle may be referred to as a second drum motion cycle. The two rearrangement motions may include a preceding rearrangement motion in which the drum rotates in one direction and a subsequent rearrangement motion in which the drum rotates in an opposite direction. In another example, the conductive accelerating motion may include a preceding stage in which the drum rotates in one direction and a subsequent stage in which the drum rotates in an opposite direction.

As mentioned above, in this embodiment, the main drying may be performed in the conductive accelerating motion. Drying may be performed in the rearrangement motion. However, the rearrangement motion is mainly intended for rearrangement and spreading of laundry.

Therefore, in the present embodiment, a single-time execution time duration of the conductive accelerating motion is preferably longer than a single-time execution time duration of the rearrangement motion. Further, it is preferable that a conducting time duration of the conductive accelerating motion is longer than that of the rearrangement motion throughout the second drum motion cycle. This may minimize the damage of the laundry and dry the laundry effectively.

In one example, the single-time execution time duration of the conductive accelerating motion may be approximately 60 seconds, while the single-time execution time duration of the rearrangement motion may be approximately 20 seconds.

After performing the conductive accelerating motion a plurality of times, the rearrangement motion may be performed a plurality of times. This pattern may be repeated. The repetition of the conductive accelerating motions and the rearrangement motions includes a drum rotation stop stage. Before and after the drum rotation stop stage, the direction of rotation of the drum is changed. The above-described gravity-based drop motion may be omitted between the conductive accelerating motion and the rearrangement motion. This is because a possibility that the load may be stuck to the inner circumferential face of the drum may be low or the adhesion force therebetween may be weak, so that the load may drop sufficiently using the rearrangement motion.

In this embodiment, a relationship between the rotation of the drum and the operation of the induction heater may be the same as in the above-described embodiment.

Figure 7:
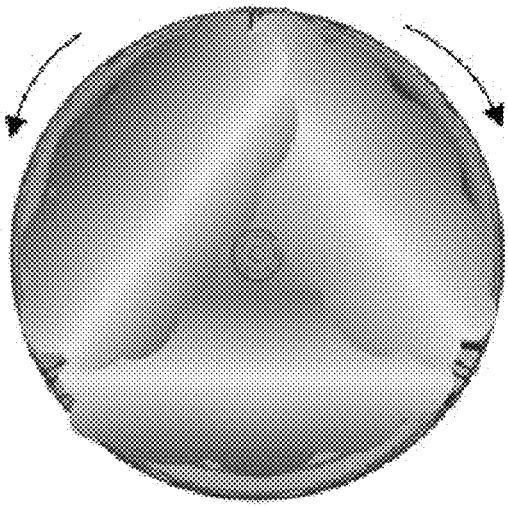
FIG. 7 shows a load and a drum in a tumbling motion for a large-sized load.

In general, when drying the load using the tumbling motion, a blanket or bulky load does not change the position and posture thereof inside the drum. That is, the blanket or bulky load is in close contact with the inner circumferential face of the drum due to a nature of inflation itself after being introduced into the drum. That is, as shown in FIG. 7, the bulky large-sized load rotates integrally with the drum at the low speed RPM as in the high speed RPM.

This large-sized load is rotated integrally with the drum even in the tumbling motion, such that the posture and position thereof are fixed. Therefore, in the conventional hot-air based drying approach, the drying imbalance may occur and an inner portion of the load may not properly dried.

Even when a large-sized load is heated using the conductive heating approach, that is, using the induction heater, the drying imbalance may occur and an inner portion of the load may not properly dried. This is because the position and posture of the large-sized load inside the drum are not changed. In other words, only a portion of the load in close contact with the inner circumferential face of the drum is dried, and a portion of the load facing the drum center is not dried properly.

In order to effectively dry such a large-sized load, in the present embodiment, the drum motion may include the aforementioned conductive accelerating motion, space securing motion, and rearrangement motion. In other words, the apparatus may efficiently dry the large-sized load by sequentially performing the three drum motions with different RPM bands or target RPMs.

Figure 8:
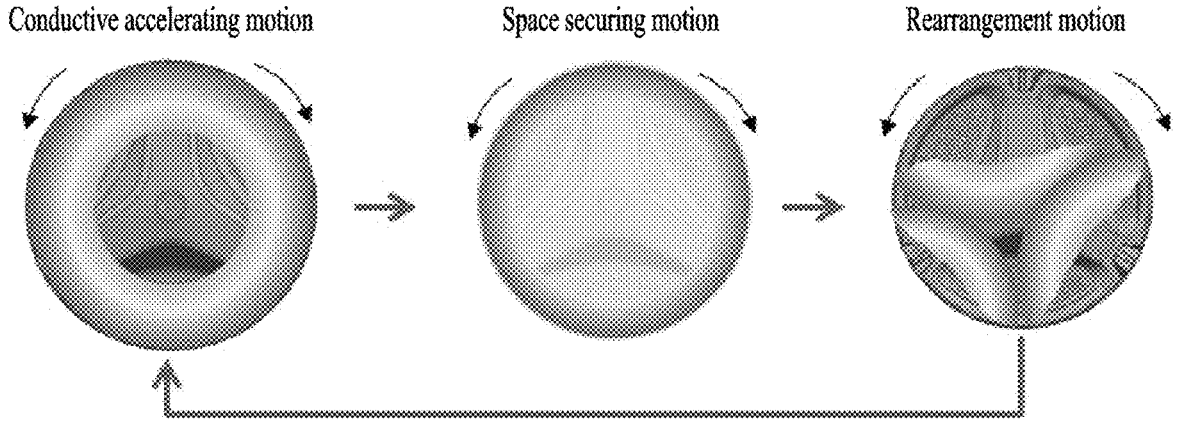
FIG. 8 shows an example of a drum motion cycle during drying according to another embodiment of the present disclosure.

Hereinafter, this embodiment will be described in detail with reference to FIG. 8.

In this embodiment, the drum motions may include the conductive accelerating motion, space securing motion, and rearrangement motion. These motions may be performed sequentially so that a single drum motion cycle may be performed. This single drum motion cycle may be referred to as a third drum motion cycle.

Bulky large-sized loads, such as blankets and paddings are more likely to have eccentricity and are not easily rearranged. Therefore, first, performing the conductive accelerating motion may bring the load into close contact with the inner face of the drum first to compress the load. Otherwise, when the space securing motion is performed before the conductive accelerating motion, vibration may be caused by the eccentricity because the RPM is relatively high in the space securing motion, and thus, the target RPM may not be achieved. Thus, a first accelerating and close contacting operation may be performed, and, then, a second accelerating and close contacting operation may be performed.

Bulky large-sized loads, such as blankets or paddings may stick to the inner circumferential face of the drum when the conductive accelerating motion is completed. Thus, even when the drum is stopped, the load may still stick to the inner circumferential face of the drum. Therefore, after the conductive accelerating motion, the space securing motion may be performed to change the position and posture of the load. When using space securing motion, the load may be more tightly attached to the inner circumferential face of the drum, while the inner space may be secured in the center region of the drum.

When the space securing motion ends, the gravity-based drop motion may be performed, and then the rearrangement motion may be performed. The rearrangement motion may be a general tumbling motion. However, preferably, the rearrangement motion may be performed in the two stages as described above. Because a sufficient space is formed in the center region of the drum, the load may drop using the first stage of the rearrangement motion such that the position and posture of the load may be changed. In this connection, the load may drop in the compressed state. Thus, the load may be easily rearranged using the second stage of the rearrangement motion. Thereafter, sufficient heating of the load may be performed while performing a new conductive accelerating motion again.

In this embodiment, one conductive accelerating motion, one space securing motion, and two rearrangement motions may constitute one cycle. This cycle may be referred to as a third drum motion cycle. The two rearrangement motions may include a preceding rearrangement motion in which the drum rotates in one direction and a subsequent rearrangement motion in which the drum rotates in an opposite direction. In another example, the conductive accelerating motion may include a preceding stage in which the drum rotates in one direction and a subsequent stage in which the drum rotates in an opposite direction.

In this embodiment, it is preferable that the conducting time duration of the conductive accelerating motion is longest and the execution time duration of the space securing motion is smallest, throughout the entire execution time duration of the third drum motion cycle. For a large-sized load, heating of the load is important. Accordingly, the conductive accelerating motion may be used to efficiently heat the load and to bring the load into a state in which the space securing motion may be smoothly performed subsequently. When performing the rearrangement motion after the space securing motion, the position and posture of the large-sized load may be changed and the load may be effectively spread.

In this embodiment, the relationship between the rotation of the drum and the operation of the induction heater may be the same as in the above-described embodiment.

In the above embodiments, the drum motion during drying may include at least one of the rearrangement motion, conductive accelerating motion, and space securing motion.

The rearrangement motion may be the same as or similar to the tumbling motion. In the rearrangement motion, the load rolls inside the drum. Therefore, when using the induction heater to heat the drum, load heating performance in the rearrangement motion is inevitably lowered. Therefore, the rearrangement motion may be performed to change the position and posture of the load and to spread the load.

The conductive (drying) accelerating motion refers to a motion in which the drum rotates at a slightly higher RPM than the threshold spin RPM so that the load is in close contact with the inner circumferential face of the drum and rotates integrally with the drum. Because the RPM in this conductive (drying) accelerating motion is lower than the space securing motion or the dehydration (spinning) RPM, the conductive (drying) accelerating motion may be used to heat the load most effectively. As the drum heats up, the higher the RPM, the more likely that the amount of heat applied to the drum is transferred not to the load but to the outside of the drum. The lower the RPM, the more likely that the heat is transferred directly to the load through the drum. However, when the drum RPM is lower than the threshold spin RPM, the load is not in contact with the drum on the top face of the drum being heated. That is, the heated portion of the drum comes into contact with the load over time. Further, the contact time duration therebetween is relatively small. Therefore, the highest drying effect may be expected when performing the conductive (drying) accelerating motion in the approximately 75 to 85 RPM band above the threshold spin RPM.

Further, the conductive (drying) accelerating motion minimizes load movement inside the drum. In other words, friction and interference between the loads may be minimized. Therefore, most of causes of the load shrinkage or deformation during drying may be eliminated.

The space securing motion may be effectively performed when the rearrangement motion alone does not facilitate load spread or rearrangement. The space securing motion may secure the center space of the drum by bringing the load into close contact with the drum using the relatively strong centrifugal force. That is, this motion may secure a space in which at least a portion of a large-sized load may fall. This is because, in general, the centrifugal force by which the large-sized load is compressed in the drum in the space securing motion is greater than a force from the user by which the large-sized load is compressed.

In another example, it is not desirable to repeatedly perform only the space securing motion. This is because the load may maintain the ring-shaped structure thereof in close contact with the drum after the space securing motion ends. Therefore, it is preferable that the rearrangement motion is additionally performed.

FIG. 3, FIG. 5, FIG. 7 and FIG. 8 schematically show the cross section of the drum and the cross section of the load in the motions of the drum. As shown, the drum is heated by the induction heater when the drum is operating. Thus, the portion of the load in contact with the inner circumferential face of the drum is heated in a relatively sufficient manner and the temperature thereof is high. In contrast, the portion of the load facing the center of the drum is relatively cold. The portion of the load at the high temperature is indicated in a stronger color to express the temperature variation in the load. In this connection, a temperature is gradually lowered when the color varies from strong red to yellow to green. Due to this heating mechanism, the rearrangement motion or space securing motion may be important. In other words, when using the rearrangement motion or space securing motion, positions of the portion facing the inner circumferential face of the drum and the portion facing the center part of the drum may be reversed with each other.

The drum motion in the above embodiments may not be the drum motion during washing, rinsing, and dehydration but the drum motion during drying. The laundry treating apparatus in the embodiments may be referred to as a direct type laundry treating apparatus in which a drum is directly operated using a motor. Therefore, the apparatus may easily implement a variety of drum motions. In this way, the drum motion may be easily controlled in various conditions.

Figure 9:
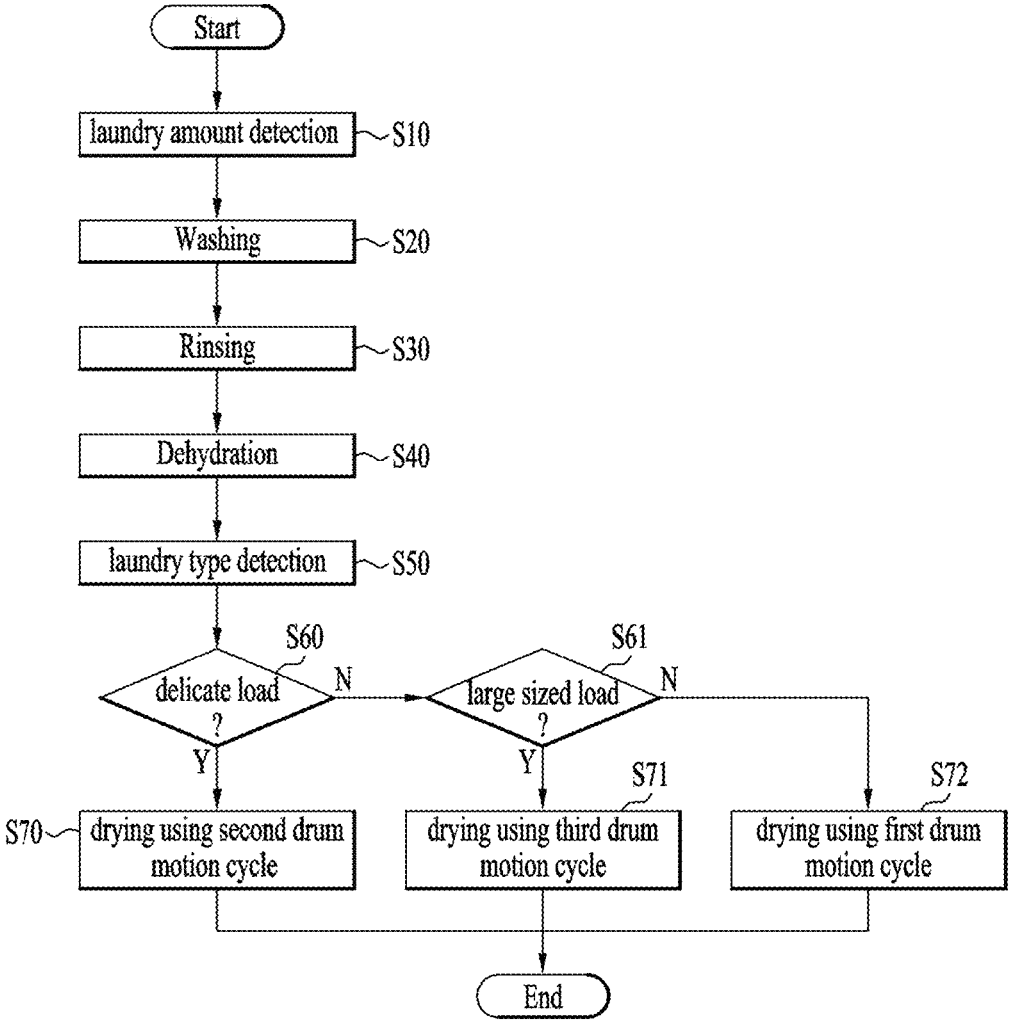
FIG. 9 shows an example of a method of controlling a laundry treating apparatus according to one embodiment of the present disclosure.

Hereinafter, with reference to FIG. 9, a method for controlling the laundry treating apparatus according to one embodiment of the present disclosure will be described in detail.

Washing and drying may be performed sequentially and automatically via selection using a course selector or via selection using course and option selectors.

First, laundry amount detection S10 may be performed before washing. This step S10 is used to detect a size of the load. A washing time, washing-water amount, or detergent amount may vary based on the size of the load.

After detecting the laundry amount, washing S20, rinsing S30, and dehydration S40 may be performed based on the detected laundry amount. It is not easy to determine a material of laundry, that is, a type of laundry, and a size of laundry based on dry laundry. Therefore, it is relatively easy to determine a type of laundry based on wet laundry.

In another example, the type of laundry may be preset by the user while the user selects a washing course. In one example, a delicate laundry course, a blanket course, and a general course may be selected by the user. That is, the type of laundry may be set by a default for each of courses provided by the course selector. Control variables for washing, rinsing, and dehydration may be set according to the type of laundry.

Therefore, a laundry type detection step S50 may be performed based on information input by the user at the time of course selection or input from separate laundry type input means. Drying may be performed using different drum motion cycles based on the determination or detection result of the laundry type detection step S50.

In one example, dehydration or spinning S50 discharging washing water and rinsing water using a centrifugal force. At this time, the dehydration or spinning RPM may be generally 800 RPM. Because the wet laundry is rotated at high speed to discharge moisture from the laundry in this step, the apparatus may grasp the laundry type in the dehydration step. In one example, when eccentricity amount is large, and thus, the dehydration target RPM is not achieved, the apparatus or the processor thereof may determine, in the dehydration step, that the laundry type is a large-sized load. That is, the apparatus or the processor thereof may determine, in the dehydration step, that the load is a large-sized load, such as a blanket or padding.

In one example, in the laundry amount detection step S10 and washing step S20, the apparatus may determine an amount of the washing-water contained in the laundry. When a relatively large amount of washing-water is required to bring the laundry from a dry state to a full wet state, the controller or processor may determine that the load is a delicate load, such as a wool or blanket, or a large-sized load such as a blanket or padding.

In another example, drying may not follow washing. That is, only drying is performed without washing. In this case, the laundry type detection S50 may include a detection of a drying target load amount. When the wet laundry is rotated with the drum, a type of the load may be determined together with the load amount.

Therefore, the laundry type detection step S50 may be carried out only at a specific time point. In the laundry type detection step S50, the type of laundry or the laundry material may be determined based on data collected in the previous steps thereto.

In one example, a condition of the drying target load, such as the amount of the drying target load or the laundry type thereof may be determined in at least one of steps including a user course selection step, a laundry amount detection step before washing, a washing step, a dehydration step, and a drying option selection step. In another example, the condition of the drying target load may be determined based on the data or input as determined or derived at the various steps.

Because the laundry treating apparatus in the embodiment may be a drum type drying and washing machine rather than a general drum type drying machine, this apparatus may vary the rotational RPM of the drum. In this way, the apparatus may easily grasp the laundry type as well as the laundry amount.

When the laundry type detection S50 ends, different modes of drying may be performed based on the detected or determined laundry type. In one example, the drying may be performed while varying the drum motion.

First, drying may be performed using the second drum motion cycle when it is determined that the load is a delicate load S60. As described above, the mechanical force between the loads may be minimized using the second drum motion cycle. Further, when using the second drum motion cycle, the effective drying may be performed by increasing the close contacting force or adhesion between the drum and load.

When it is determined that the load is a large-sized load such as a blanket or padding S61, the drying may be performed using the third drum motion cycle. As mentioned above, effective drying may be performed via close contact between the load and drum which is achieved by the two stages. Further, the subsequent rearrangement motion may be used to easily change the position and posture of the load, and to achieve the rearrangement of the load. Therefore, even when the load is a large-sized load, drying thereof may be performed evenly.

When it is determined that the load is not the large-sized load and delicate load but is a general load, the drying may be performed using the first drum motion cycle. When the load is the general load, the load size is relatively small and the load amount is large and the load tends to be resistant to damage by the mechanical force. Therefore, the load may be adhered closely to the drum easily and thus may be compressed. Therefore, the space securing motion at a relatively high RPM may be easily performed when the load is the general load. Further, the load may drop easily using the drum stop or gravity-based drop motion after performing the space securing motion. Thereafter, the rearrangement motion may be performed to easily change the position and posture of the load, and to achieve the rearrangement of the load.

As a result, in the present embodiment, drying may be performed while implementing the different drum motion cycles based on the condition of the drying target load or the type of the drying target load, thereby providing optimum drying performance. In particular, the condition of the drying target load, such as the amount of the drying target load or the laundry type thereof may be determined in at least one of steps including a user course selection step, a laundry amount detection step before washing, a washing step, a dehydration step, and a drying option selection step. In another example, the condition of the drying target load may be determined based on the data or input as determined or derived at the various steps. Then, the optimum drum motion cycle for drying may be determined based on the determined condition of the load.

In particular, the present embodiment provides the laundry treating apparatus for heating the drum and directly heating and drying the laundry in contact with the drum. Due to the laundry heating mechanism, various types of drum motion cycles may be implemented based on the laundry type. That is, the present embodiment provides the laundry treating apparatus in which the laundry may be dried while varying the drum motion cycle according to the laundry type such that, irrelevant to the laundry type, all faces of the laundry are evenly adhered to the inner circumferential face of the drum.

Further, the present embodiment may provide the laundry treating apparatus in which a single drum motion cycle may include the drum motions having at least two or more different target RPMs such that the load is evenly dried to prevent partial excessive drying and partial insufficient drying of the load.

In the above description, the present disclosure has been described with reference to embodiments of the present disclosure. However, various changes and modifications may be made at a level of a knowledge of a skilled person to the art. Thus, it will be understood that such changes and modifications are included within the scope of the present disclosure unless they depart from the scope of the present disclosure.

What is claimed is:

1. An object treating apparatus comprising:

a tub;

a drum rotatably disposed within the tub and configured to receive an object therein;

an induction heater disposed on the tub and configured to heat an outer circumferential face of the drum facing the heater;

a motor configured to rotate the drum; and a processor configured to control the induction heater to dry the object, and configured to, during drying the object, operate the drum, by controlling revolutions per minute (RPM) of the drum, in:

a conductive accelerating motion in which the drum is rotated at a first target RPM that causes the object to rotate integrally with the drum while the object is in contact with an inner circumferential face of the drum; and a rearrangement motion in which the drum is rotated at a second target RPM lower than the first target RPM of the conductive accelerating motion, wherein the conductive accelerating motion includes two stages in which the drum is rotated at two different target RPMs respectively, the two different target RPMs including the first target RPM.

2. The apparatus of claim 1, wherein the two different target RPMs of the two stages in the conductive accelerating motion include a low target RPM that is equal to or greater than a maximum RPM of a tumbling motion of the drum.

3. The apparatus of claim 2, wherein the two different target RPMs of the two stages in the conductive accelerating motion includes a high target RPM that is higher than a threshold spin RPM at which the drum is rotated to cause the object to come into contact with the drum and begin to rotate integrally with the drum.

4. The apparatus of claim 3, wherein, based on the threshold spin RPM being in a range of 60 to 70 RPM, the high target RPM of the two different target RPMs of the two stages of the conductive accelerating motion is in a range of 75 to 85 RPM.

5. The apparatus of claim 1, wherein the second target RPM of the rearrangement motion is equal to an RPM of a tumbling motion of the drum at which the drum is rotated to cause the object to rise up and fall down.

6. The apparatus of claim 1, wherein the rearrangement motion includes a first stage and a subsequent second stage, wherein the drum is rotated at a third target RPM in the first stage, the third target RPM that is lower than a RPM of a tumbling motion of the drum, wherein the drum is rotated at a fourth target RPM in the second stage, the fourth target RPM that is higher than a minimum RPM of the tumbling motion and lower than or equal to a maximum RPM of the tumbling motion.

7. The apparatus of claim 6, wherein, based on the RPM of the tumbling motion being in a range of 40 to 60 RPM, the third target RPM is in a range of 25 to 35 RPM lower than the minimum RPM of the tumbling motion, and the fourth target RPM is equal to 60 RPM as the maximum RPM of the tumbling motion.

8. The apparatus of claim 5, wherein the processor is configured to control the drum to perform a drum motion cycle, the drum motion cycle including the conductive accelerating motion and the rearrangement motion.

9. The apparatus of claim 8, wherein the drum motion cycle includes one conductive accelerating motion and two rearrangement motions.

10. The apparatus of claim 9, wherein during a time between the two rearrangement motions, the drum is operated to stop and change a direction of rotation of the drum.

11. The apparatus of claim 10, wherein the two rearrangement motions include a preceding rearrangement motion and a subsequent rearrangement motion, the preceding rearrangement motion being performed subsequent to the conductive accelerating motion, wherein a direction of drum rotation in the preceding rearrangement motion is opposite to a direction of drum rotation in the conductive accelerating motion, and wherein a direction of drum rotation in the subsequent rearrangement motion is opposite to a direction of drum rotation in the preceding rearrangement motion.

12. The apparatus of claim 8, wherein, based on satisfaction of a condition of a drying target load, the processor is further configured to perform drying using the drum motion cycle.

13. The apparatus of claim 12, wherein the condition of the drying target load includes at least one of a condition that the drying target load is a delicate load, a condition that the drying target load is a large-sized load, or a condition that the drying target load is a general load.

14. The apparatus of claim 13, wherein the processor is configured to determine whether to use the drum motion cycle based on the condition of the drying target load, and perform drying using the drum motion cycle based on determination of the drying target load being the delicate load.

15. The apparatus of claim 13, wherein the condition of the drying target load is determined by at least one of: a user course selection, a laundry amount detection before washing, a washing, a dehydration, or a drying option selection.

16. The apparatus of claim 8, wherein the processor is further configured to control the induction heater to operate only when the drum rotates at an RPM equal to or higher than a predefined RPM during drying.

17. The apparatus of claim 16, wherein the predefined RPM is higher than 0 RPM and lower than a smallest target RPM in the drum motion cycle.

18. The apparatus of claim 1, wherein the processor is configured to operate the drum in a space securing motion in which the drum is rotated at a fifth target RPM designed to create a space inside the drum to thereby permit the object to move to a center of the drum, and wherein the processor is configured to control the drum to perform:

(i) a first drum motion cycle of a drying process in which an execution time of the rearrangement motion is longer than an execution time of the space securing motion, (ii) a second drum motion cycle of the drying process in which one conductive acceleration motion and two rearrangement motions are performed, wherein an execution time of the conductive accelerating motion is longer than an execution time of the rearrangement motion, and (iii) a third drum motion cycle of the drying process in which one conductive accelerating motion, one space securing motion, and two rearrangement motions.

19. An object treating apparatus comprising:

a tub;

a drum rotatably disposed within the tub and configured to receive an object therein;

an induction heater disposed on the tub and configured to heat an outer circumferential face of the drum facing the heater;

a motor configured to rotate the drum; and a processor configured to control the induction heater to dry the object, and configured to, during drying the object, operate the drum in a drum motion cycle, the drum motion cycle including:

a conductive accelerating motion in which the drum is rotated at a RPM that is higher than a threshold spin RPM, wherein the drum is rotated at the threshold spin RPM to cause the object to come into contact with the drum and begin to rotate integrally with the drum; and a subsequent rearrangement motion in which the drum is rotated at a target RPM to cause the object to tumble in the drum, wherein the rearrangement motion is repeated, wherein the conductive accelerating motion includes two stages in which the drum is rotated at two different target RPMs respectively, the two different target RPMs including the first target RPM.

20. The apparatus of claim 19, wherein in the drum motion cycle, the rearrangement motion is performed more frequently than the conductive accelerating motion.

* * * * *